US006792698B2

(12) United States Patent
Kobayashi et al.

(10) Patent No.: US 6,792,698 B2
(45) Date of Patent: Sep. 21, 2004

(54) SHOE

(75) Inventors: Kazuhiko Kobayashi, Kobe (JP); Seigou Sakagami, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 10/337,289

(22) Filed: Jan. 7, 2003

(65) Prior Publication Data

US 2004/0006892 A1 Jan. 15, 2004

(30) Foreign Application Priority Data

Jan. 15, 2002 (JP) ..... 2002-005668

(51) Int. Cl.[7] ..... A43B 23/28; A43C 15/00

(52) U.S. Cl. ..... 36/59 C; 36/127; D2/951; D2/960

(58) Field of Search ..... 36/59 R, 59 C, 36/127; D2/951, 953, 954, 955, 956, 960

(56) References Cited

U.S. PATENT DOCUMENTS

| | | | | | |
|---|---|---|---|---|---|
| D190,162 | S | * | 4/1961 | Hubbard | D2/960 |
| 3,006,085 | A | * | 10/1961 | Bingham, Jr. | 36/59 C |
| 4,281,467 | A | * | 8/1981 | Anderie | 36/32 R |
| D291,944 | S | * | 9/1987 | Tong | D2/955 |
| D354,162 | S | * | 1/1995 | O'Rorke | D2/954 |
| D360,292 | S | * | 7/1995 | Murray | D2/951 |
| D385,392 | S | * | 10/1997 | Cass | D2/954 |
| D416,671 | S | * | 11/1999 | Tsuzuki | D2/961 |
| D442,357 | S | * | 5/2001 | Burt | D2/959 |
| 6,289,611 | B1 | | 9/2001 | Patterson et al. | |
| D461,298 | S | * | 8/2002 | Urie et al. | D2/955 |
| D474,330 | S | * | 5/2003 | McClaskie | D2/952 |
| 6,665,961 | B2 | * | 12/2003 | Kobayashi et al. | 36/127 |
| 2002/0040539 | A1 | | 4/2002 | Kobayashi et al. | |
| 2003/0019129 | A1 | * | 1/2003 | Kobayashi et al. | 36/59 C |

FOREIGN PATENT DOCUMENTS

| | | |
|---|---|---|
| GB | 2 328 362 A | 2/1999 |

* cited by examiner

*Primary Examiner*—M. D. Patterson
(74) *Attorney, Agent, or Firm*—Birch, Stewart, Kolasch & Birch, LLP

(57) ABSTRACT

A shoe body for a left foot which includes an outsole body, double-side-slip-preventing projections and additional projections formed on a bottom surface of the outsole body, the outsole body, the double-side-slip-preventing projections and the additional projections being formed integrally and having a composition containing rubber or synthetic resin as a principal component. Each of the double-side-slip-preventing projections includes a bottom surface to be a grounding surface, a tiptoe side slip prevention wall, and a heel side slip prevention wall. The tiptoe side slip prevention wall is formed substantially along a line to be convex in a tiptoe direction and the heel side slip prevention wall is formed substantially along a line to be convex in a heel direction. A space provided between two double-side-slip-preventing projections opposed to each other by interposing a portion in which the line to be convex in the tiptoe direction and the line to be convex in the heel direction come in contact with each other, is set to be 2 mm or more.

5 Claims, 11 Drawing Sheets

(a)

(b)

SHOE

This nonprovisional application claims priority under 35 U.S.C. § 119(a) on Patent Application No. 2002-005668 filed in JAPAN on Jan. 15, 2002, which is herein incorporated by reference.

BACKGROUND OF THE INVENTION

1. Field of the Invention

The present invention relates to a shoe, and more particularly to an improvement in a pattern of a bottom surface of the shoe.

2. Description of the Related Art

When hitting a golf ball, a golf player sets an address such that a line connecting right and left tiptoes is in almost parallel with a hitting direction. In an address for a right-handed golf player, a left foot is positioned on the front side in the hitting direction and a right foot is positioned on the rear side in the hitting direction. In the address, a head of a golf club is positioned close to a golf ball. In this state, the golf player starts take-back, pulls the head rearward and then swings the golf club upward. The highest position of the head swung upward is equivalent to a top position. In the top position, a downswing is started and the head is swung downward so that the head impacts the golf ball. After the impact, the golf player swings the golf club forward and then upward (follow-through). Thus, a finish is attained.

From the top position to the finish, the golf player carries out a body turn by setting a left foot as a pivot. At the same time, the golf player kicks the ground by a right foot to transmit the force to the golf ball. In other words, a right-handed golf player uses a left foot as a pivoting foot and a right foot as a kicking foot. To the contrary, a left-handed golf player uses a right foot as the pivoting foot and a left foot as the kicking foot.

From the top position to the finish, great force is applied to both feet of the golf player. In some cases, the force causes golf shoes to slip off from the ground. In which the slip is caused, a swing form is disordered so that a misshot is generated.

In order to attain slip prevention, a needle-like spike pin formed of metal or ceramics is provided on the bottom surfaces of the golf shoes. In such golf shoes, the slip is considerably prevented. However, there is a problem in that the spike pin damages a lawn on a green, a floor in a clubhouse and a road surface of a passage for walking which is provided in a golf course. Moreover, the golf shoes having the spike pin give a push-up feeling and are not comfortable for the golf player to wear. In recent years, the golf shoes having the spike pin have not been preferred for use.

Golf shoes having projections formed of rubber or synthetic resin which are provided on bottom surfaces in place of the spike pin have been proposed and spread. Such golf shoes rarely damage a lawn and are very comfortable to wear. In the golf shoes, however, there is a problem in that the projection has a smaller slip prevention performance than the spike pin.

The present inventor investigated a vector of force applied to feet from the top position to the impact (that is, a magnitude and a direction) and found the following. For a pivoting foot, force is roughly applied in almost a direction from a heel to a tiptoe. In detail, the force is mainly applied to a rear portion in the hitting direction of the foot in the top position (toward an inside for the pivoting foot of the golf player) and the direction is equivalent to a slightly rearward tiptoe direction. Depending on the progress of a swing, the position to which the force is mainly applied is transferred to the center of the foot, and then a front position (toward an outside for the pivoting foot of the golf player). Depending on the progress of the swing, the direction of the force is also transferred in a complete tiptoe direction, and then in a slightly forward tiptoe direction. It is supposed that these changes are caused by a body turn using a pivoting foot and the movement of a weight.

For a kicking foot, force is roughly applied in almost a direction from the tiptoe to the heel. In detail, the force is mainly applied to a front portion in the hitting direction of the foot in the top position (toward an inside for the kicking foot of the golf player) and the direction is also equivalent to a slightly forward heel direction. Depending on the progress of a swing, the position to which the force is mainly applied is transferred to the center of the foot, and then a rear portion (toward an outside for the kicking foot of the golf player). Depending on the progress of the swing, the direction of the force is also transferred in a complete heel direction, and then in a slightly rearward heel direction. It is supposed that these changes are caused by movement of a weight from the kicking foot to the pivoting foot at the time of the start of a downswing and the subsequent rotation of the kicking foot.

Japanese Laid-Open Patent Publication No. 2001-299406 has disclosed golf shoes which consider a difference in a role between a pivoting foot and a kicking foot. In the golf shoes, a projection is formed along a line to be convex in a tiptoe direction over a bottom surface of a shoe body for a pivoting foot and a projection is formed along a line to be convex in a heel direction over a bottom surface of a shoe body for a kicking foot. In a golf swing having such a very complicated movement pattern mixing a turning movement (body turn) and a translation movement, the golf shoes display an excellent slip prevention performance.

However, in the case in which the slip prevention is achieved by the projections having different patterns on left and right, it is necessary to prepare both the golf shoes for a right-handed golf player and a left-handed golf player and the burden of a cost is increased for golf shoe manufacturers. If the left-handed golf player wears golf shoes for the right-handed golf player or the right-handed golf player wears golf shoes for the left-handed golf player, there is also a problem in that the slip prevention is insufficient during a swing. There is also a problem in that a shoe body for a pivoting foot and a shoe body for a kicking foot in the golf shoes easily slip on upward and downward slopes respectively.

In consideration of these problems, the present inventor has proposed golf shoes in Japanese Patent Application No. 2000-235175 in which a double-side-slip-preventing projection including a tiptoe side slip prevention wall formed along a line to be convex in a tiptoe direction and a heel side slip prevention wall formed along a line to be convex in a heel direction is mainly formed. Also in the case in which any of right-handed and left-handed golf players wears the golf shoes, the double-side-slip-preventing projection suppresses the slip of a pivoting foot (a slip in almost the tiptoe direction) and the slip of a kicking foot (a slip in almost the heel direction) during a golf swing. In the golf shoes, it is not necessary to make left and right projection patterns different from each other.

In a portion (hereinafter referred to as a "contact point") in which a line to be convex in the tiptoe direction and a line to be convex in the heel direction of the golf shoes come in contact with each other, two double-side-slip-preventing projections are opposed to each other with the contact point provided therebetween. In these cases, a heel side slip prevention wall of the double-side-slip-preventing projection positioned on the tiptoe side and a tiptoe side slip prevention wall of the adjacent double-side-slip-preventing projection positioned on the heel side are very close to each other and the tiptoe side slip prevention wall inhibits slip prevention effects from being produced by the heel side slip prevention wall, and the heel side slip prevention wall inhibits the slip prevention effects from being produced by the tiptoe side slip prevention wall. The slip prevention effects of the golf shoes are not always sufficient.

SUMMARY OF THE INVENTION

A shoe according to the present invention comprises an outsole body. A large number of projections formed of rubber or synthetic resin are provided on a bottom surface of the outsole body. Double-side-slip-preventing projections are mainly formed as the projections. The double-side-slip-preventing projection includes a tiptoe side slip prevention wall formed substantially along a line to be convex in a tiptoe direction and a heel side slip prevention wall formed substantially along a line to be convex in a heel direction. A space between two double-side-slip-preventing projections opposed to each other by interposing a portion in which the line to be convex in the tiptoe direction and the line to be convex in the heel direction come in contact with each other is set to be 2 mm or more.

The shoe comprises the double-side-slip-preventing projection, and furthermore, the space between the two double-side-slip-preventing projections opposed to each other with the contact point provided therebetween is sufficiently large. Also in the case in which force is applied in any direction, therefore, a slip can be suppressed.

It is preferable that a ratio of the number of contact points in which a space between two double-side-slip-preventing projections opposed to each other in the contact point is 2 mm or more to the total number of the contact points should be 5% or more. In such shoes, the slip can be more suppressed.

It is preferable that a ratio of the number of the double-side-slip-preventing projections to the total number of the projections should be 50% or more. In such shoes, the slip can be more suppressed.

It is preferable that an interior angle on a vertical section which is formed by the tiptoe side slip prevention wall and the outsole body should be 60 degrees or more. Moreover, it is preferable that an interior angle on a vertical section which is formed by the heel side slip prevention wall and the outsole body should be 60 degrees or more. In such shoes, the slip can be more suppressed.

DESCRIPTION OF THE PREFERRED EMBODIMENTS

Figure 1:
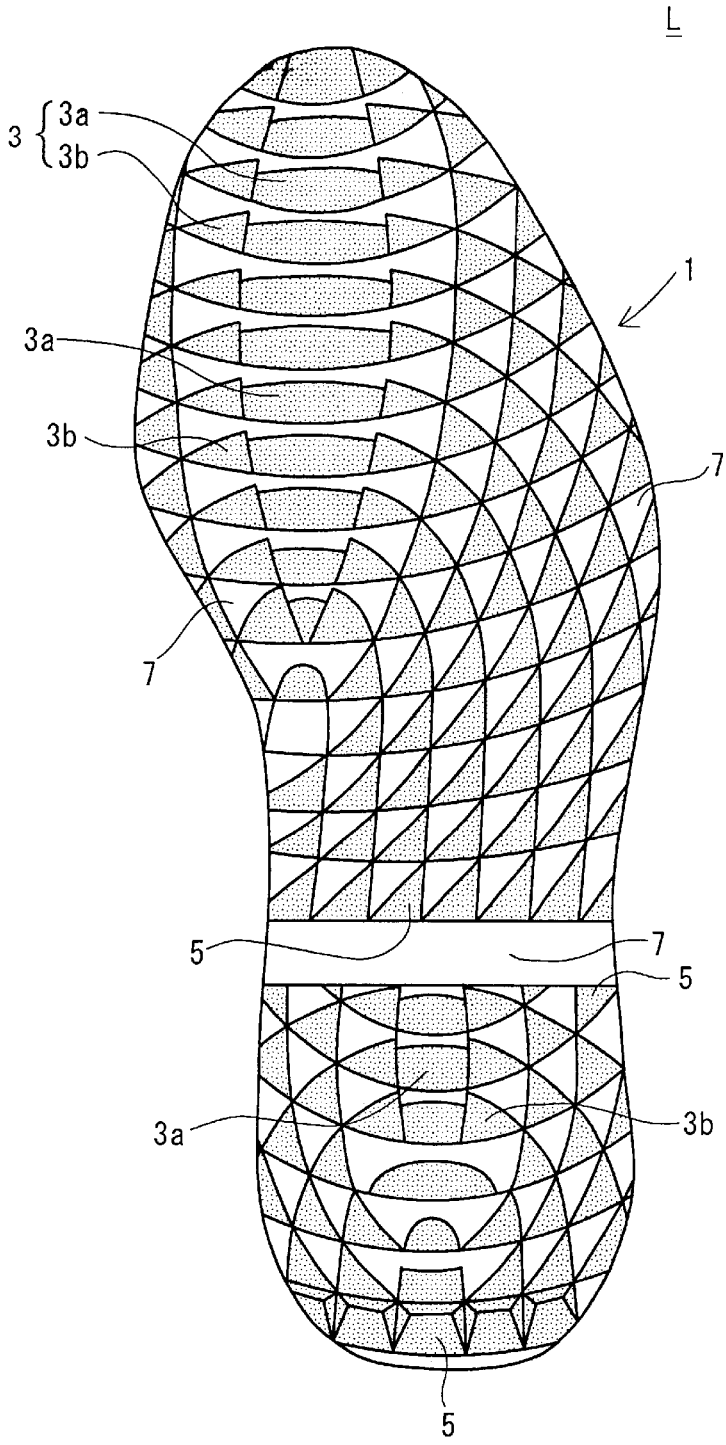
FIG. 1 is a bottom view showing a shoe body L for a left foot of golf shoes according to an embodiment of the present invention, FIG. 2(*a*) is a typical view showing a line Ct to be convex in a tiptoe direction in the shoe body L for a left foot in FIG. 1, FIG. 2(*b*) is a typical view showing a line Ch to be convex in a heel direction of the shoe body L for a left foot, FIG. 3(*a*) is an enlarged perspective view showing an example of a double-side-slip-preventing projection of the shoe body L for a left foot in FIG. 1, FIG. 3(*b*) is a bottom view showing the double-side-slip-preventing projection in FIG. 3(*a*), FIG. 4(*a*) is an enlarged perspective view showing another double-side-slip-preventing projection of the shoe body L for a left foot in FIG. 1, FIG. 4(*b*) is a bottom view showing the double-side-slip-preventing projection in FIG. 4(*a*), FIG. 5(*a*) is an enlarged view showing a part of the shoe body L for a left foot in FIG. 1, FIG. 5(*b*) is a sectional view taken along a line B—B in FIG. 5(*a*)

The present invention will be described below in detail based on a preferred embodiment with reference to the Drawings, wherein, FIG. 1 is a bottom view showing a shoe body L for a left foot of a golf shoe according to an embodiment of the present invention. The golf shoe comprises the same upper portion as that of ordinary golf shoes, which is not shown. As shown in FIG. 1, the right side is set to be the front side in a hitting direction; the left side is set to be the rear side in the hitting direction; the upward direction is set to be a tiptoe direction, and the downward direction is set to be a heel direction.

The shoe body L for the left foot includes an outsole body 1. A large number of projections 3 and 5 are formed on the bottom surface of the outsole body 1. In FIG. 1, the portion shown in dots indicates the projections 3 and 5. The projections 3 and 5 are including a double-side-slip-preventing projection 3 and another projection 5. A portion of the bottom surface other than the projections 3 and 5 defines a flat portion 7. The outsole body 1 and the projections 3 and 5 are formed integrally. The outsole body 1 and the projections 3 and 5 are formed of a composition containing rubber or a synthetic resin as a principal component.

Figure 2:
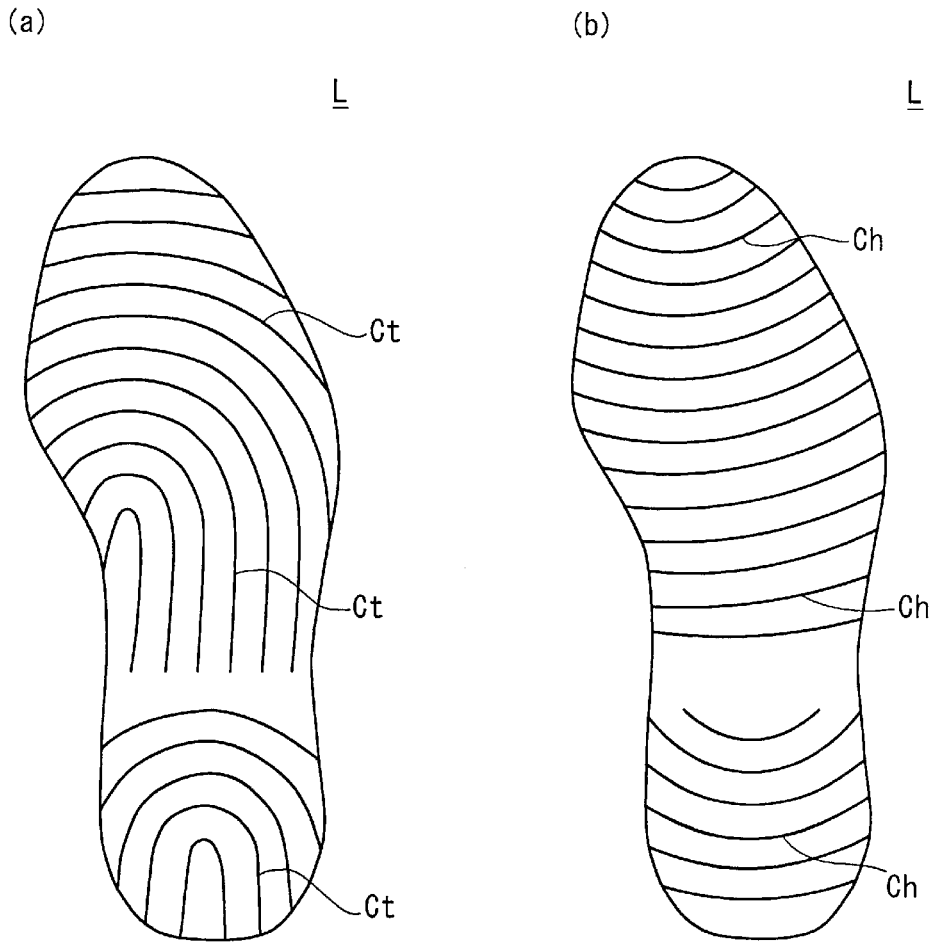

The double-side-slip-preventing projection 3 is formed substantially along a line to be convex in the tiptoe direction and a line to be convex in a heel direction. FIG. 2(*a*) is a typical view showing a line Ct to be convex in the tiptoe direction in the shoe body L for the left foot of FIG. 1. Moreover, FIG. 2(*b*) is a typical view showing a line Ch to be convex in the heel direction in the shoe body L for the left foot of FIG. 1. The line Ct to be convex in the tiptoe direction represents a line going from one end in the tiptoe direction, passing through a portion which is the closest to the tiptoe, going in the heel direction and ending at the other end. Moreover, the line Ch, to be convex in the heel direction represents a line going from one end in the heel direction, passing through a portion which is the closest to the heel, going in the tiptoe direction and ending at the other end. The line Ct to be convex in the tiptoe direction and the line Ch to be convex in the heel direction may be circular arcs or parabolas. Furthermore, a curve having an inflection point in the middle such as a sine curve may be used. Moreover, a combination of a plurality of segments or a combination of a segment and a curve may be used. In the golf shoes, 15 lines Ct come in contact with one line Ch, respectively. Also 15 lines Ch come in contact with one line Ct, respectively. There are 15 contact points of the line Ct and the line Ch.

It is preferable that the line Ct to be convex in the tiptoe direction and the line Ch to be convex in the heel direction can be designed by the following method. First of all, a golf player is caused to carry out a golf swing and the floor reaction force in each of the horizontal and vertical directions during the swing is measured by a three-dimensional floor reaction force meter to calculate the ratio of a horizontal load to a vertical load. Next, a peak point at which the ratio has a maximum value is determined. Then, a start point at which the ratio has 60% of the maximum value in a stage of a rise toward the maximum value and an end point at which the ratio has 60% of the maximum value in a stage of a fall from the maximum value are determined. Subsequently, horizontal component vectors of three-dimensional floor reaction force data at a predetermined interval between the start point and the end point are arranged with origins thereof coincident with each other. Next, a reference line to connect the front ends of the vectors is assumed. A reference line for a pivoting foot is obtained by the measurement of a floor reaction force in the pivoting foot and a reference line for a kicking foot is obtained by the measurement of the floor reaction force in the kicking foot. The reference line for the pivoting foot which is subjected to variable power at a predetermined ratio is set to be the line Ct to be convex in the tiptoe direction. Moreover, the reference line for the kicking foot which is subjected to variable power at a predetermined ratio is set to be the line Ch to be convex in the heel direction. Such a floor reaction force measuring method has been disclosed in Japanese Patent Application No. 2000-219431, for example. All 16 lines Ct do not need to be determined by the floor reaction force measurement. Similarly, all 21 lines Ch do not need to be determined by the floor reaction force measurement. A part of one line Ct may be determined by the floor reaction force measurement or a part of one line Ch may be determined by the floor reaction force measurement.

Figure 3:
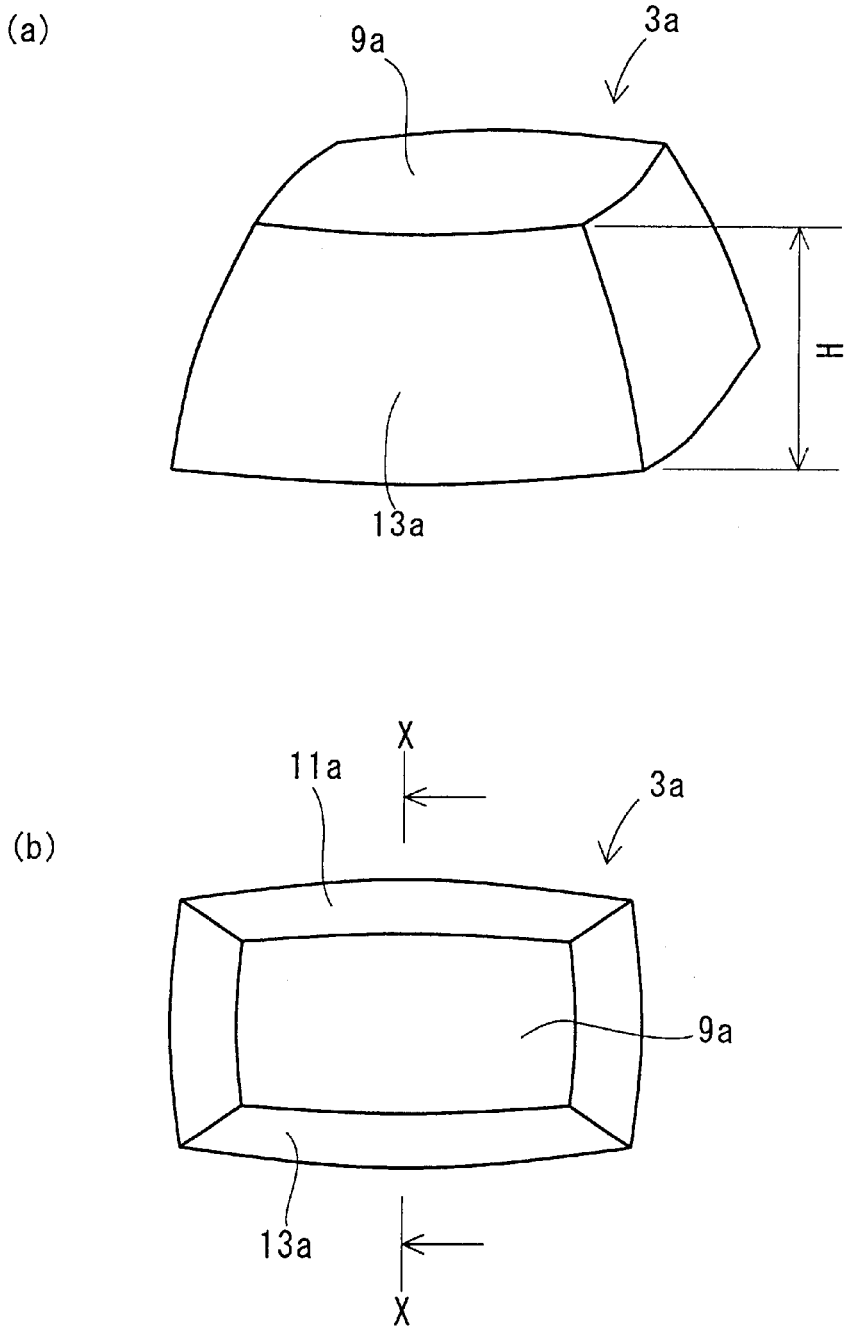

FIG. 3(*a*) is an enlarged perspective view showing an example of a double-side-slip-preventing projection 3*a* of the shoe body L for the left foot in FIG. 1 and FIG. 3(*b*) is a bottom view thereof (which is obtained by seeing FIG. 3(*a*) from above) In FIG. 3(*b*), an upward direction is set to be the tiptoe direction and a downward direction is set to be the heel direction. The double-side-slip-preventing projection 3*a* includes a bottom surface 9*a* to be a grounding surface and four side walls including a tiptoe side slip prevention wall 11*a* and a heel side slip prevention wall 13*a*. The tiptoe side slip prevention wall 11*a* is formed substantially along the line Ct to be convex in the tiptoe direction and is a curved surface to be convex in the tiptoe direction. The heel side slip prevention wall 13*a* is formed substantially along the line Ch to be convex in the heel direction and is a curved surface to be convex in the heel direction.

Figure 4:
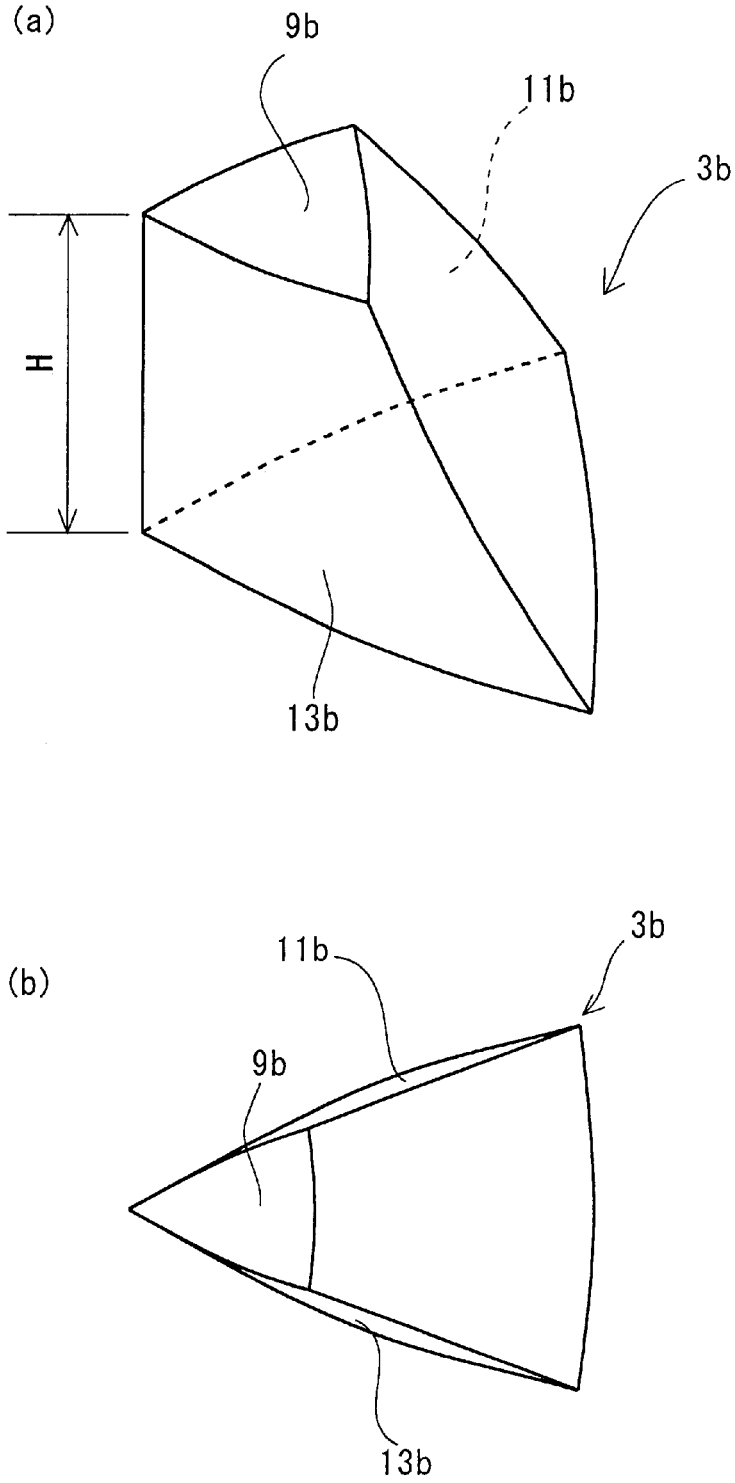

FIG. 4(*a*) is an enlarged perspective view showing another double-side-slip-preventing projection 3*b* of the shoe body L for the left foot in FIG. 1 and FIG. 4(*b*) is a bottom view thereof (which is obtained by seeing FIG. 4(*a*) from above). In FIG. 4(*b*), an upward direction is set to be the tiptoe direction and a downward direction is set to be the heel direction. The double-side-slip-preventing projection 3*b* includes a bottom surface 9*b* to be a grounding surface and three sidewalls including a tiptoe side slip prevention wall 11*b* and a heel side slip prevention wall 13*b*. The tiptoe side slip prevention wall 11*b* is formed along the line Ct to be convex in the tiptoe direction and is a curved surface to be convex in the tiptoe direction. The heel side slip prevention wall 13*b* is formed along the line Ch to be convex in the heel direction and is a curved surface to be convex in the heel direction.

Figure 5:
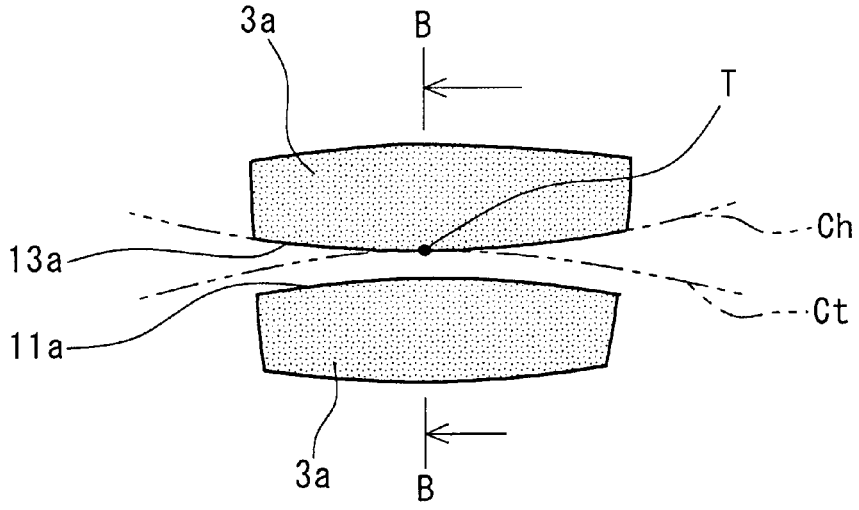
Figure 5:
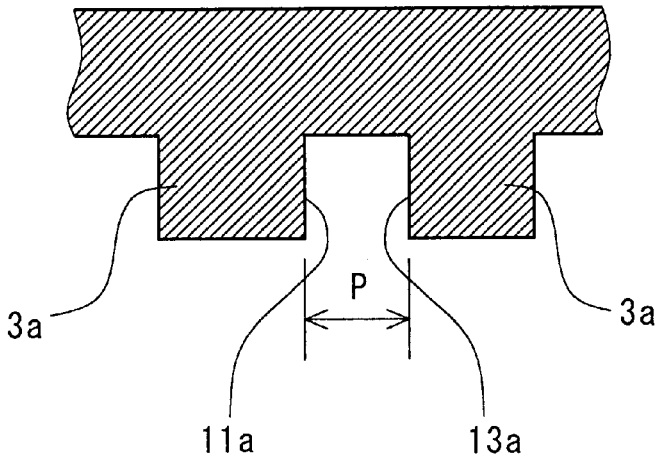

FIG. 5(*a*) is an enlarged view showing a part of the shoe body L for a left foot in FIG. 1 and FIG. 5(*b*) is a sectional view taken along a line B—B in FIG. 5(*a*). These drawings show two double-side-slip-preventing projections 3*a* opposed to each other by interposing the contact point T of the line Ct to be convex in the tiptoe direction and the line Ch to be convex in the heel direction. In FIG. 5(*a*), the upper side indicates the tiptoe direction and the lower side indicates the heel direction. In FIG. 5(*b*), the right direction indicates the tiptoe direction and the left direction indicates the heel direction.

As shown in FIG. 5(*a*), the tiptoe side slip prevention wall 11*a* of the double-side-slip-preventing projection 3*a* is moved slightly backward in the heel direction (downward in FIG. 5(*a*)) from the line Ct to be convex in the tiptoe direction. In other words, the tiptoe side slip prevention wall 11*a* is formed along a line obtained by moving the line Ct in slightly parallel in the heel direction. Accordingly, a space P between two double-side-slip-preventing projections 3*a* opposed to each other with the contact point P provided therebetween is large. The space P indicates a distance between the tiptoe side slip prevention wall 11*a* of the double-side-slip-preventing projection 3*a* and the heel side slip prevention wall 13*a* of another double-side-slip-preventing projection 3*a*. The space P indicates a distance in a horizontal direction between the lower end of the tiptoe side slip prevention wall 11*a* and the lower end of the heel side slip prevention wall 13*a*. In this specification, both the tiptoe side slip prevention wall formed along the line Ct and the tiptoe side slip prevention wall formed along the line obtained by moving the line Ct in slightly parallel in the heel direction will be referred to as "a tiptoe side slip prevention wall formed 'substantially' along a line to be convex in the tiptoe direction".

The heel side slip prevention wall 13*a* of the double-side-slip-preventing projection 3*a* may be formed along the line obtained by moving the line Ch in slightly parallel in the tiptoe direction. Also in this case, the space P is increased. In this specification, both the heel side slip prevention wall formed along the line Ch and the heel side slip prevention wall formed along the line obtained by moving the line Ch in slightly parallel in the tiptoe direction will be referred to as "a heel side slip prevention wall formed 'substantially' along a line to be convex in the heel direction".

The space P is set to be 2 mm or more. Consequently, slip prevention can be achieved by the tiptoe side slip prevention wall of the double-side-slip-preventing projection on the heel side without the inhibition of the adjacent double-side-slip-preventing projection on the tiptoe side. Similarly, the slip prevention can be achieved by the heel side slip prevention wall of the double-side-slip-preventing projection on the tiptoe side without the inhibition of the adjacent double-side-slip-preventing projection on the heel side. From this viewpoint, the space P is more preferably 3 mm or more, and particularly preferably 4 mm or more. The space P is preferably 15 mm or less. In some cases in which the space P is more than this range, the width of the double-side-slip-preventing projection is decreased so that a rigidity thereof is reduced. From this viewpoint, the space P is more preferably 12 mm or less, and particularly preferably 8 mm or less.

Figure 6:
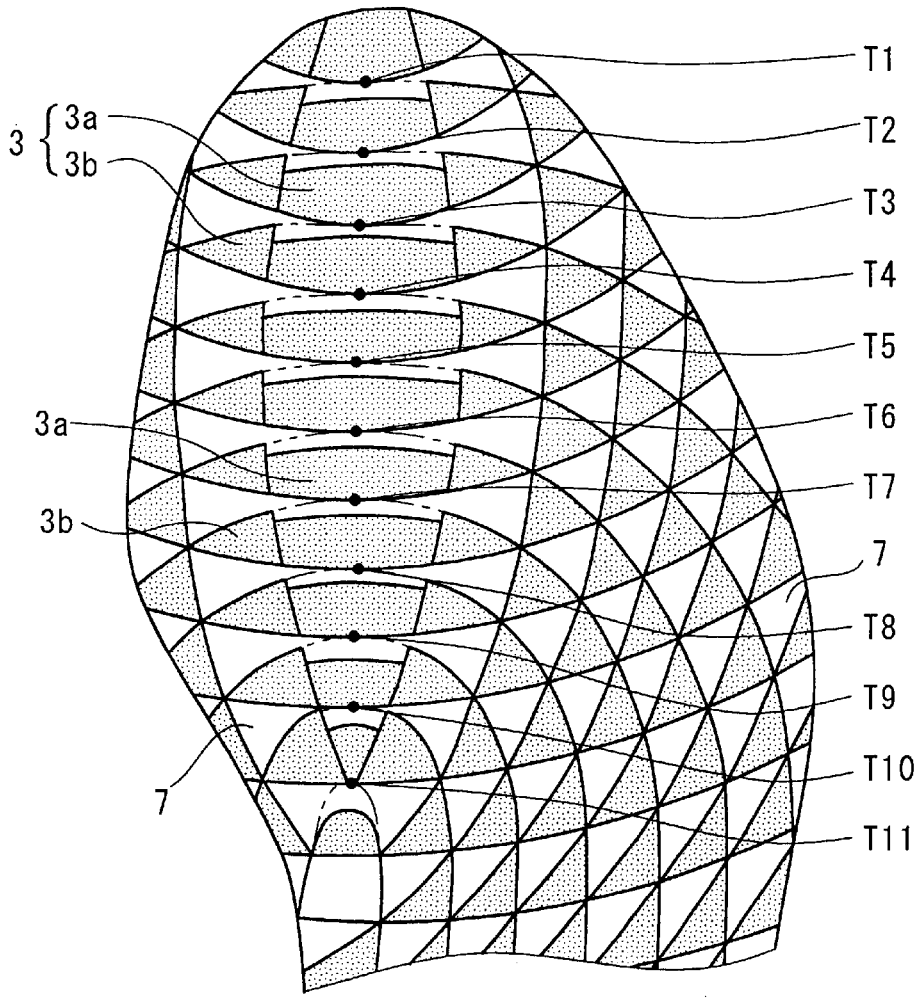
FIG. 6 is an enlarged bottom view showing a part of the shoe body L for a left foot in FIG. 1.
Figure 7:
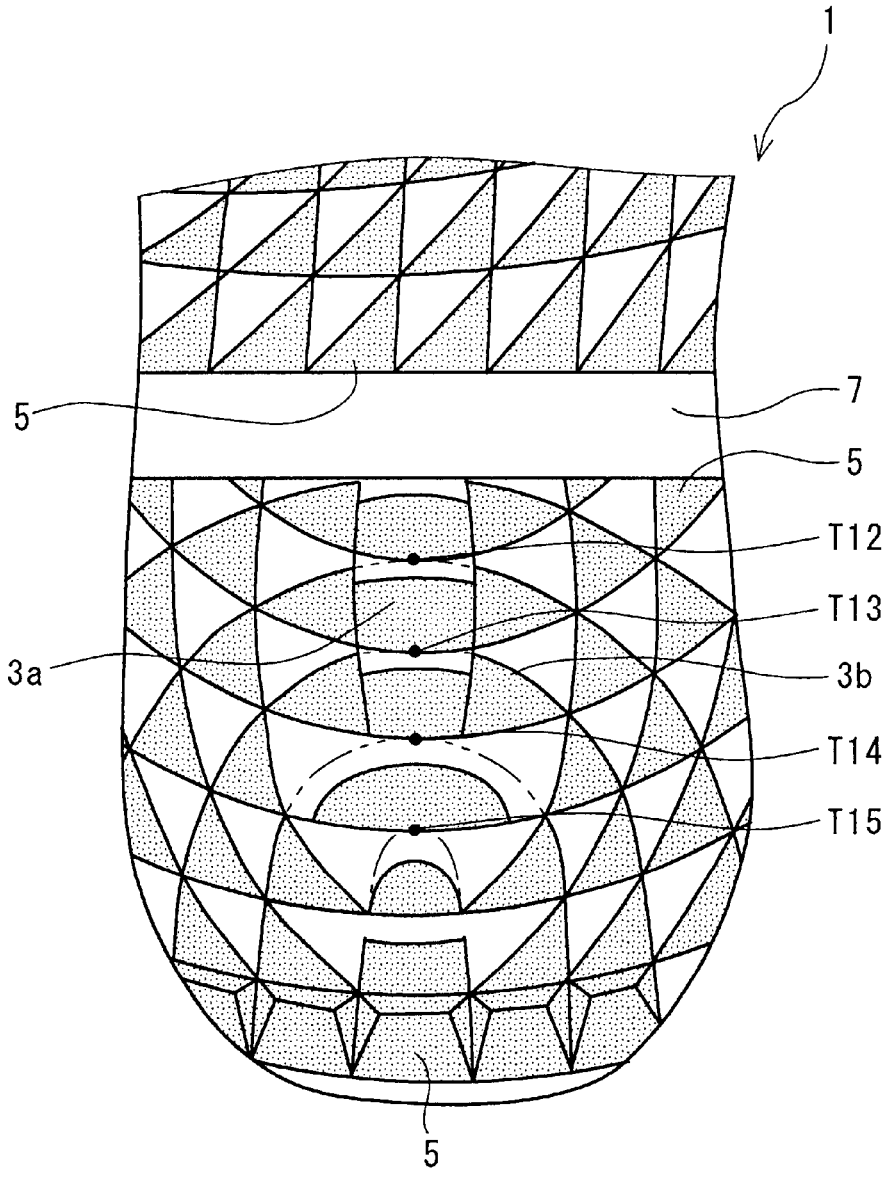
FIG. 7 is an enlarged bottom view showing a part of the shoe body L for a left foot in FIG. 1.

In respect of a slip prevention performance, the ratio of the number of contact points T in which a space between two double-side-slip-preventing projections opposed to each other with the contact point T provided therebetween is 2 mm or more to the total number of the contact points T is preferably 5% or more, more preferably 30% or more, and particularly preferably 50% or more. Ideally, the ratio is 100%. At all 15 contact points (indicated as T1 to T15 in FIGS. 6 and 7) of the shoe body L for the left foot shown in FIG. 1, the space P is set to be 2 mm or more.

Figure 8:
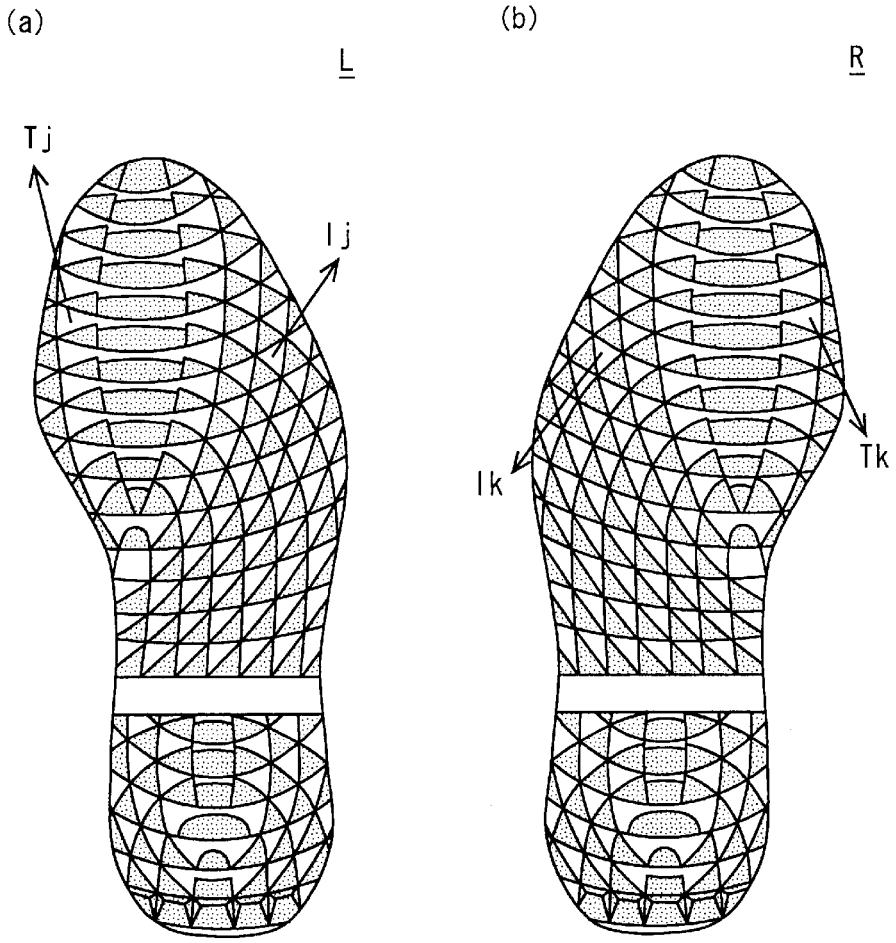
FIG. 8 is a bottom view showing the golf shoes in FIG. 1 together with a vector of force applied to the golf shoes in the case in which a right-handed golf player wears the golf shoes.

FIG. 8 is a bottom view showing the golf shoes in FIG. 1 together with a vector of force applied to the golf shoes in the case in which a right-handed golf player wears the golf shoes. FIG. 8(*a*) is a bottom view showing the same shoe body L for a left foot as that in FIG. 1 and FIG. 8(*b*) is a bottom view showing a shoe body R for a right foot in the golf shoes. The shoe body R for the right foot has a shape obtained by transversely inverting the shape of the shoe body L for the left foot. The left foot (pivoting foot) wears the shoe body L and the right foot (kicking foot) wears the shoe body R.

In FIG. 8(*a*), an arrow Tj indicates a vector of force applied to the shoe body L for the left foot in a top position. Moreover, an arrow Ij indicates a vector of force applied to the shoe body L for the left foot immediately before an impact. During a swing from the top position to a point immediately before the impact, the position and direction of the force applied to the shoe body L for the left foot are momentarily changed in an almost clockwise direction in the drawing from a state shown in the arrow Tj to a state shown in the arrow Ij.

As described above, the tiptoe side slip prevention walls 11*a* and 11*b* of the double-side-slip-preventing projections 3*a* and 3*b* are formed substantially along the line Ct to be convex in the tiptoe direction. At any time that the vector of the force is transferred from the state shown in the arrow Tj to the state shown in the arrow Ij, any portion of the tiptoe side slip prevention walls 11*a* and 11*b* is almost orthogonal to a direction of the vector. Consequently, the shoe body L for the left foot can be effectively prevented from slipping in almost the tiptoe direction.

In FIG. 8(*b*), an arrow Tk indicates a vector of force applied to the shoe body R for the right foot in the top position. Moreover, an arrow Ik indicates a vector of force applied to the shoe body R for the right foot immediately before the impact. During the swing from the top position to the point immediately before the impact, the position and direction of the force applied to the shoe body R for the right foot are momentarily changed in an almost clockwise direction in the drawing, generally, from a state shown in the arrow Tk to a state shown in the arrow Ik.

As described above, the heel side slip prevention walls 13*a* and 13*b* of the double-side-slip-preventing projections 3*a* and 3*b* are formed substantially along the line Ch to be convex in the heel direction. At any time that the vector of the force is transferred from the state shown in the arrow Tk to the state shown in the arrow Ik, any portion of the heel side slip prevention walls 13*a* and 13*b* is almost orthogonal to the direction of the vector. Consequently, the shoe body R for the right foot can be effectively prevented from slipping in almost the heel direction.

Figure 9:
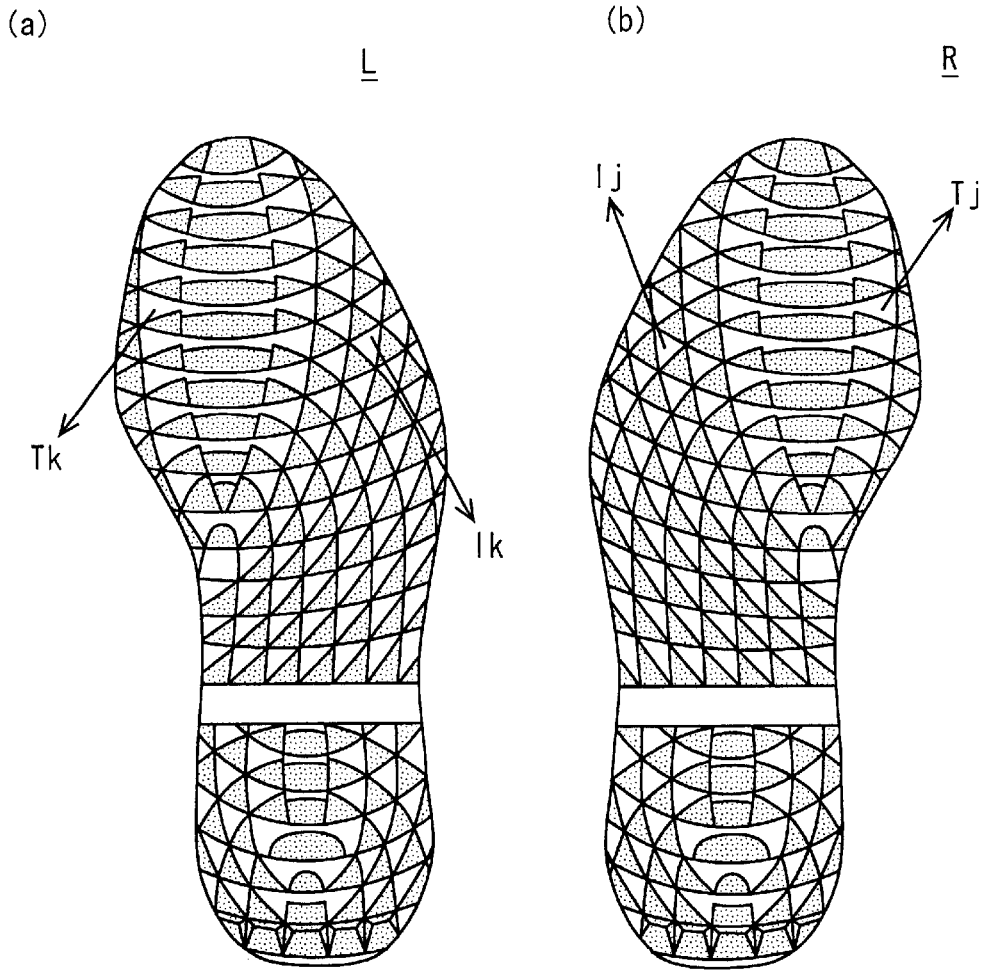
FIG. 9 is a bottom view showing the golf shoes in FIG. 8 together with a vector of force applied to the golf shoes in the case in which a left-handed golf player wears the golf shoes.

FIG. 9 is a bottom view showing the golf shoes in FIG. 8 together with a vector of force applied to the golf shoes in the case in which a left-handed golf player wears the golf shoes. The left foot (kicking foot) wears the shoe body L and the right foot (pivoting foot) wears the shoe body R.

In FIG. 9(*a*), an arrow Tk indicates a vector of force applied to the shoe body L for the left foot in the top position. Moreover, an arrow Ik indicates a vector of force applied to the shoe body L for the left foot immediately before the impact. During the swing from the top position to the point immediately before the impact, the position and direction of the force applied to the shoe body L for the left foot are momentarily changed in an almost clockwise direction in the drawing, generally, from a state shown in the arrow Tk to a state shown in the arrow Ik.

As described above, the heel side slip prevention walls 13*a* and 13*b* of the double-side-slip-preventing projections 3*a* and 3*b* are formed substantially along the line Ch to be convex in the heel direction. At any time that the vector of the force is transferred from the state shown in the arrow Tk to the state shown in the arrow Ik, any portion of the heel side slip prevention walls 13*a* and 13*b* is almost orthogonal to the direction of the vector. Consequently, the shoe body L for the left foot can be effectively prevented from slipping in almost the heel direction.

In FIG. 9(*b*), an arrow Tj indicates a vector of force applied to the shoe body R for the right foot in the top position. Moreover, an arrow Ij indicates a vector of force applied to the shoe body R for the right foot immediately before the impact. During the swing from the top position to the point immediately before the impact, the position and direction of the force applied to the shoe body R for the right foot are momentarily changed in an almost clockwise direction in the drawing from a state shown in the arrow Tj to a state shown in the arrow Ij.

As described above, the tiptoe side slip prevention walls 11*a* and 11*b* of the double-side-slip-preventing projections 3*a* and 3*b* are formed substantially along the line Ct to be convex in the tiptoe direction. At any time that the vector of the force is transferred from the state shown in the arrow Tj to the state shown in the arrow Ij, any portion of the tiptoe side slip prevention walls 11*a* and 11*b* is almost orthogonal to the direction of the vector. Consequently, the shoe body R for the right foot can be effectively prevented from slipping in almost the tiptoe direction.

Thus, the tiptoe side slip prevention walls 11*a* and 11*b* mainly display a slip prevention performance if a right-handed golf player wears the shoe body L, and the heel side slip prevention walls 13*a* and 13*b* mainly display the slip prevention performance if a left-handed golf player wears the shoe body L. Moreover, the heel side slip prevention walls 13*a* and 13*b* mainly display the slip prevention performance if the right-handed golf player wears the shoe body R, and the tiptoe side slip prevention walls 11*a* and 11*b* mainly display the slip prevention performance if the left-handed golf player wears the shoe body R. More specifically, also in the case in which any of the right-handed and left-handed golf players wears the golf shoes, the double-side-slip-preventing projections 3*a* and 3*b* can prevent the golf shoes from slipping during a swing. The golf shoes are suitable for both the right-handed golf player and the left-handed golf player. In addition, the tiptoe side slip prevention walls 11*a* and 11*b* of the golf shoes can prevent the shoe body L for the left foot and the shoe body R for the right foot from slipping on a downward slope, and the heel side slip prevention walls 13*a* and 13*b* of the golf shoes can prevent the shoe body L for the left foot and the shoe body R for the right foot from slipping on an upward slope.

Figure 10:
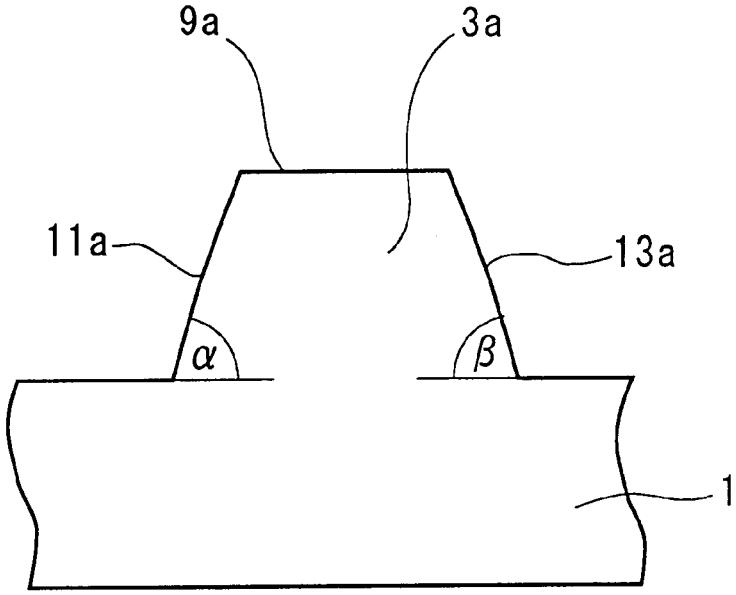
FIG. 10 is a sectional view taken along a line X—X in FIG. 3(*b*)

FIG. 10 is a sectional view (vertical sectional view) taken along a line X—X in FIG. 3(*b*). In FIG. 10, the outsole body 1 is shown together with the double-side-slip-preventing projection 3*a*. In FIG. 10, α indicates an interior angle formed by the tiptoe side slip prevention wall 11*a* and the outsole body 1. Moreover, β indicates an interior angle formed by the heel side slip prevention wall 13*a* and the outsole body 1. The interior angles α and β are preferably 60 degrees or more. In some cases in which the interior angles α and β are less than the above-mentioned range, the slip prevention performance of the shoe body L and the shoe body R becomes insufficient. From this viewpoint, it is particularly preferable that the interior angles α and β should be 80 degrees or more. It is preferable that the interior angles α and β should be 120 degrees or less. In some cases in which the interior angles α and β are more than the above-mentioned range, it is hard to remove the outsole body 1 from a mold after molding. From this viewpoint, it is particularly preferable that the interior angles α and β should be 100 degrees or less. Also the double-side-slip-preventing projection 3*b* shown in FIG. 4, an interior angle on a vertical section formed by each of the tiptoe side slip prevention wall 11*b* and the heel side slip prevention wall 13*b* and the outsole body 1 is preferably 60 degrees or more and particularly preferably 80 degrees or more, and preferably 120 degrees or less and particularly preferably 100 degrees or less.

In each of the shoe body L for the left foot and the shoe body R for the right foot, a ratio of the number of the double-side-slip-preventing projections 3 to the total number of the projections 3 and 5 is preferably 50% or more, more preferably 70% or more, and most preferably 85% or more. Ideally, the ratio is 100%. Consequently, it is possible to more prevent the shoe body L and the shoe body R from slipping.

A height of the double-side-slip-preventing projection 3 (shown in an arrow H in FIGS. 3(*a*) and 4(*a*)) is preferably 2 mm to 25 mm. In some cases in which the height H is less than the above-mentioned range, the slip prevention performance becomes insufficient. From this viewpoint, it is particularly preferable that the height H should be 5 mm or more. If the height is more than the above-mentioned range, the projection is easily bent. From this viewpoint, it is particularly preferable that the height H should be 15 mm or less.

While only the double-side-slip-preventing projection 3 and another projection 5 are protruded from the bottom surface of the outsole body 1 in the golf shoes, a pin formed of crosslinked rubber, synthetic resin or the like may be further provided supplementarily. In particular, the pin is provided in the vicinity of a portion corresponding to the root of a thumb (that is, a portion to which a high foot pressure is applied) so that the shoe body L for the left foot and the shoe body R for the right foot can be more prevented from slipping.

It is preferable that a ratio (grounding area ratio) of the total grounding area of the projections 3 and 5 to the bottom surface area of the outsole body 1 in each of the shoe body L and the shoe body R should be 20% to 80%. In some cases in which the grounding area ratio is less than the above-mentioned range, the slip prevention property on a hard road surface through which the projections 3 and 5 stick with difficulty becomes insufficient. From this viewpoint, it is particularly preferable that the grounding area ratio should be 30% or more. In some cases in which the grounding area ratio is more than the above-mentioned range, a grounding pressure becomes insufficient. From this viewpoint, it is particularly preferable that the grounding area ratio should be 70% or less. The bottom surface area of the outsole body 1 implies the area obtained on the assumption that a bottom surface is flat (that is, the projections 3 and 5 are not formed).

It is preferable that the numbers of the projections 3 and 5 in each of the shoe body L and the shoe body R should be 10 to 1000, respectively. If the numbers of the projections 3 and 5 are less than the above-mentioned range, a region having a large area in which the projections 3 and 5 are not present at all is generated. For example, in some cases in which the same region is positioned just below a sesamoid, the slip prevention performance becomes insufficient during walking. From this viewpoint, it is particularly preferable that the numbers of the projections 3 and 5 should be 20 or more. In some cases in which the numbers of the projections 3 and 5 are more than the above-mentioned range, the sizes of the individual projections 3 and 5 are reduced so that the rigidity of each of the projections 3 and 5 becomes insufficient. From this viewpoint, it is particularly preferable that the numbers of the projections 3 and 5 should be 100 or less.

EXAMPLES

Example 1

A rubber composition containing butadiene rubber as a principal component was put in a mold and was heated to form a shoe outsole having an outsole body and double-side-slip-preventing projections. An upper portion and an insole were attached to the shoe outsole to obtain golf shoes according to an example 1. The shape and arrangement of the projection of the golf shoes are shown in FIGS. 1 to 10. A space P between the double-side-slip-preventing projections in all contact points (T1 to T15) is 6 mm.

Examples 2 to 5 and Comparative Example 1

Golf shoes according to examples 2 to 5 and a comparative example 1 were obtained in the same manner as in the example 1 except that a different mold was used. These golf shoes comprise projection patterns which are almost equivalent to those of the golf shoes according to the example 1 except that the space P between the contact points (T1 to T15) is set as shown in the following Table 1.

Comparative Example 2

Figure 11:
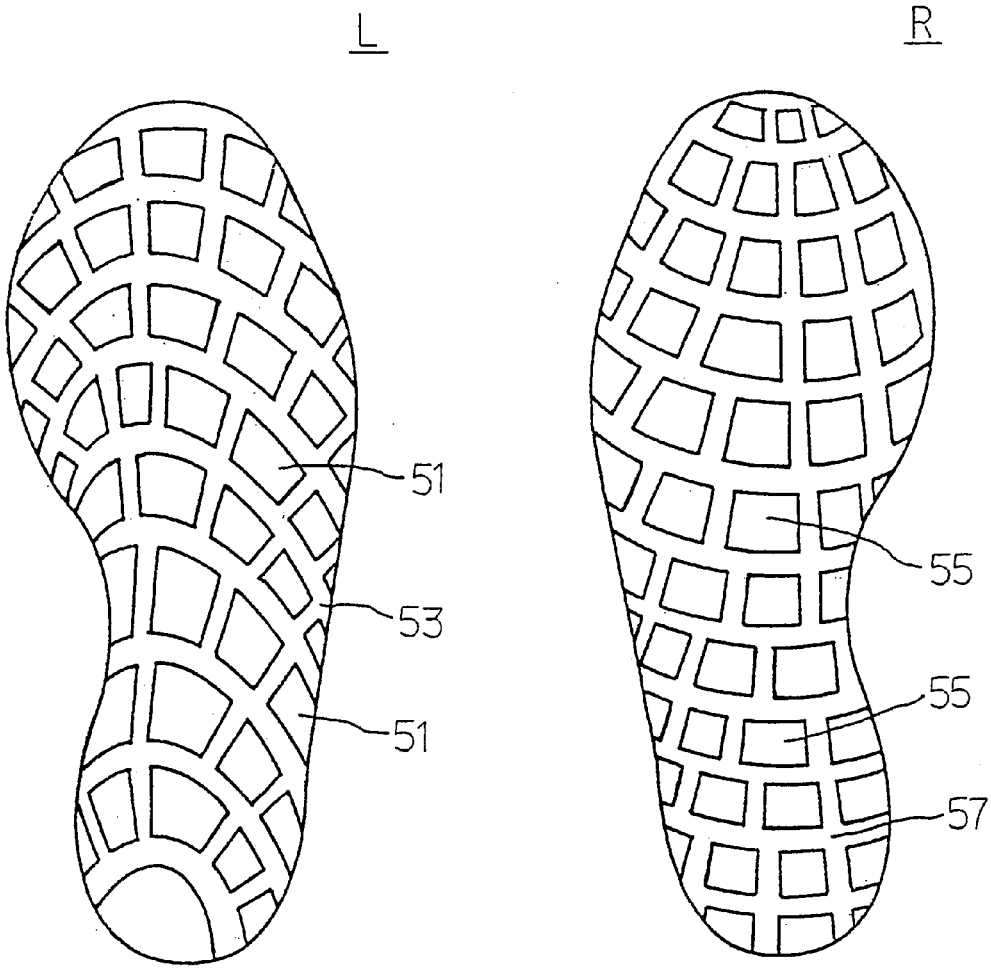
FIG. 11 is a bottom view showing golf shoes according to a comparative example of the present invention.

Golf shoes according to a comparative example 2 were obtained in the same manner as those in the example 1 except that a mold was changed and the pattern of an outsole was varied. The shape and arrangement of the projection of the golf shoes are shown in FIG. 11. A shoe body L for a left foot has a projection 51 and a flat portion 53, and the projection 51 is formed along a line to be convex in a tiptoe direction. A shoe body R for a right foot has a projection 55 and a flat portion 57, and the projection 55 is formed along a line to be convex in a heel direction.

Evaluation of Slip Prevention Performance

A right-handed golf player and a left-handed golf player wore golf shoes and hit a golf ball with a driver on a teeing ground of a golf course. Moreover, the golf players walked on a downward slope having a lawn surface. Thus, a slip prevention performance was functionally evaluated in fifteen stages of "1" to "15". The most difficulty to slip was set to "15" and the most easiness to slip was set to "1". The result is shown in the following Table 1.

TABLE 1

Result of Evaluation of Golf Shoes

| | | Example 1 | Example 2 | Example 3 | Example 4 | Example 5 | Comparative Example 1 | Comparative Example 2 |
|---|---|---|---|---|---|---|---|---|
| Space P (mm) | T1 | 6 | 6 | 3 | 2 | 1 | 1 | — |
| | T2 | 6 | 0 | 3 | 2 | 1 | 1 | — |
| | T3 | 6 | 6 | 3 | 2 | 1 | 1 | — |
| | T4 | 6 | 0 | 3 | 2 | 1 | 1 | — |
| | T5 | 6 | 6 | 3 | 2 | 6 | 1 | — |
| | T6 | 6 | 0 | 3 | 2 | 1 | 1 | — |
| | T7 | 6 | 6 | 3 | 2 | 1 | 1 | — |
| | T8 | 6 | 0 | 3 | 2 | 1 | 1 | — |
| | T9 | 6 | 6 | 3 | 2 | 1 | 1 | — |
| | T10 | 6 | 0 | 3 | 2 | 1 | 1 | — |
| | T11 | 6 | 6 | 3 | 2 | 1 | 1 | — |
| | T12 | 6 | 0 | 3 | 2 | 1 | 1 | — |
| | T13 | 6 | 6 | 3 | 2 | 1 | 1 | — |
| | T14 | 6 | 0 | 3 | 2 | 1 | 1 | — |
| | T15 | 6 | 6 | 3 | 2 | 1 | 1 | — |
| Slip Prevention Performance (right-handed) ) | | 15 | 14 | 14 | 13 | 12 | 10 | 15 |
| Slip Prevention Performance (left-handed) | | 15 | 14 | 14 | 13 | 12 | 10 | 6 |

As is apparent from the Table 1, also in the case in which any of the right-handed golf player and the left-handed golf player wears the golf shoes according to each of the examples, the golf shoes slip with difficulty. From the result of the evaluation, the advantage of the present invention is obvious.

While the present invention has been described in detail by taking, as an example, the case in which the golf shoes are used for golf, the shoes according to the present invention display an excellent slip prevention performance also in various motions.

The above description is only illustrative and can be variously changed without departing from the scope of the present invention.

What is claimed is:

1. A shoe comprising an outsole body, a plurality of projections formed of rubber or a synthetic resin provided on a bottom surface of the outsole body, said plurality of projections including, a double-side-slip-preventing projection including a tiptoe side slip prevention wall formed substantially along a line to be convex in a tiptoe direction and a heel side slip prevention wall formed substantially along a line to be convex in a heel direction, and a space provided between two double-side-slip-preventing projections opposed to each other in which the line to be convex in the tiptoe direction and the line to be convex in the heel direction come in contact with each other, is set to be 2 mm or more.

2. The shoe according to claim 1, wherein a ratio of the number of contact points in which a space between two double-side-slip-preventing projections opposed to each other in which the line to be convex in the tiptoe direction and the line to be convex in the heel direction come in contact with each other is 2 mm or more, to the total number of contact points is 5% or more.

3. The shoe according to claim 1, wherein a ratio of the number of the double-side-slip-preventing projections to the total number of the projections is 50% or more.

4. The shoe according to claim 2, wherein the ratio of the number of the double-side-slip-preventing projections to the total number of the projections is 50% or more.

5. The shoe according to any of claims 1 to 4, wherein an interior angle on a vertical section which is formed by the tiptoe side slip prevention wall and the outsole body is 60 degrees or more and an interior angle on a vertical section which is formed by the heel side slip prevention wall and the outsole body is 60 degrees or more.

* * * * *